US006154935A

United States Patent [19]

Gregory et al.

[11] Patent Number: 6,154,935

[45] Date of Patent: Dec. 5, 2000

[54] QUICK RELEASE BUCKLE FOR USE ON BACKPACKS AND THE LIKE

[75] Inventors: Wayne Gregory, Temecula; Gary Fraze, San Dimas, both of Calif.

[73] Assignee: Bianchi International, Temecula, Calif.

[21] Appl. No.: 09/324,355

[22] Filed: Jun. 2, 1999

[51] Int. Cl.[7] ..... A44B 11/25

[52] U.S. Cl. ..... 24/614

[58] Field of Search ..... 24/170, 191–193, 24/614–616; D11/216, 218; 2/322, 421

[56] References Cited

U.S. PATENT DOCUMENTS

| | | | |
|---|---|---|---|
| 3,696,471 | 10/1972 | Mermelstein | 24/193 |
| 4,030,689 | 6/1977 | Rodriguez . | |
| 4,282,634 | 8/1981 | Krauss . | |
| 4,864,700 | 9/1989 | Kasai | 24/614 X |
| 4,945,614 | 8/1990 | Kasai | 24/615 X |
| 5,205,021 | 4/1993 | Durand | 24/170 X |
| 5,832,573 | 11/1998 | Howell | 24/616 X |

*Primary Examiner*—James R. Brittain
*Attorney, Agent, or Firm*—John E. Wagner

[57] ABSTRACT

A quick release buckle particularly for use on backpacks including a two part body, an engagement part and a receptor part each of which include attachments for a strap or belt. The body parts telescope into engagement with one body part including a flexible finger and the other a catch. A buckle release strap is secured to the flexible finger and to the body by a snap fastener. At least one upstanding wing on a body part protects the buckle release strap from unintended release.

21 Claims, 4 Drawing Sheets

QUICK RELEASE BUCKLE FOR USE ON BACKPACKS AND THE LIKE

FIELD OF THE INVENTION

This invention relates to the field of carriers and more particularly to buckles and fasteners for use on backpack straps or belts in which a reliable quick release capability is required along with effective protection from inadvertent release.

BACKGROUND OF THE INVENTION

In recent years there has been an tremendous expansion of interest in the design of new and improved fasteners which has matched the expansion of the use of strap carried backpacks for adults and school children, hikers and the military. The result has been that easy release fasteners have been produced employing mating engaging plastic parts of easily moldable materials such as nylon and the acetyl resin of the type sold under the trademark DELRIN. Innovative designs have produced easy engagement buckles with acceptable reliability.

When the requirement of easy release is added to the design requirements, the danger of unintended release becomes a real challenge to the buckle designer. When a buckle must be released by a single hand, one or two fingers, in a matter of a second or two, the danger exists of some unintended intervening action releasing the buckle. Examples of such intervening actions are brushing against branches or structures or casual contact of a hand or an object carried with the buckle. In the case where the buckle is on a belt, there may be a loss of the entire belt and its carried equipment. In the case of buckles on a backpack strap, the unintended release at the least is a distraction which may result in a possible accident to the wearer of the backpack. In the case of military applications, quick release of a buckle may also be critical in a tactical situation where unintended release may be life threatening.

The need for quick release buckles, particularly for military applications, is well described in U. S. Pat. No. 5,205,021 which discloses a two part plastic buckle with a flexible tongue with an enlarged end, designed to be easily grasped by a gloved hand to release the buckle.

BRIEF DESCRIPTION OF THE INVENTION

Faced with this general need for an improved quick release buckle, we have invented a new two part telescoping, interlocking buckle body with an internal protected flexible finger which is integral with one of the two parts and engages the second part for positive locking. The two body parts include a receptor body part and an engaging body part (female and male respectively). A flexible tab is secured to the flexible finger to lift the finger and release it to allow the engaging and the receipt or strap or body parts to disengage. The flexible strap includes a snap fastener and one of the plastic parts also includes the matching snap fastener part so that the buckle can not release until the snap fastener is disengaged. The flexible strap and its snap fastener part extend through a protective channel defined by integral wings of the plastic body parts so that the strap is secure from release from any force acting from either side of the buckle. The outer end of the strap extends beyond the buckle by a short distance which is sufficient to all allow the end of the strap to be grasped by either a gloved or bare hand.

The snap fastener can be released only by the strap being pulled or lifted nearly normal (e.g. 70°–90°) to the face of the buckle. The first intentional action releases the strap but does not disengage the buckle so that a mere disengagement of the strap carried snap fastener from its mating part does not release the buckle. To release the buckle, a second direction of movement of the strap is required. The strap must be pulled away from the face of the buckle. These two movements can easily be learned to be combined in one natural movement.

If the buckle is used on a shoulder strap of a backpack, the releasing movement is a lifting up of the flexible strap to release of the snap fastener and pulling the strap away from the buckle. The buckle then releases. Engagement of the buckle involves telescoping and snapping the two snap fastener parts together in a conventional telescoping movement followed by snapping the snap fastener parts together. The protective wings also provide a second function of directing the strap into the protective channel for easy manual engagement of the snap fastener without the need to observe the strap or the snap fastener.

BRIEF DESCRIPTION OF THE DRAWING

This invention may be better understood from the following Detailed Description of the Invention and by reference to the drawing, in which.

DETAILED DESCRIPTION OF THE INVENTION

Figure 1:
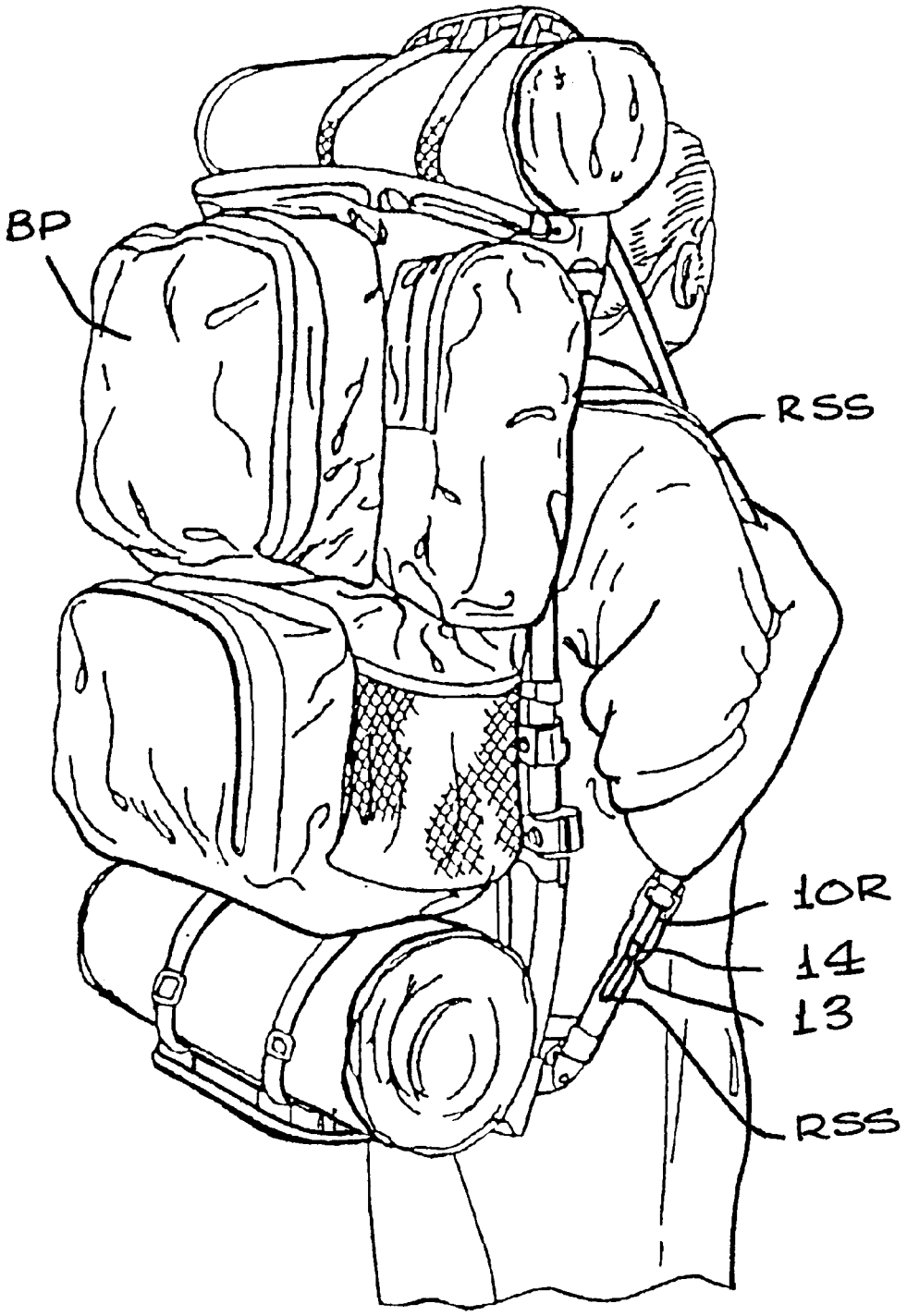
FIG. 1 is a perspective view of a hiker with a large backpack which includes the buckles of this invention.

For a view of a strap or belt buckle, which combines the properties of effective locking and quick release, reference should now be made to FIGS. 1 through 5. In FIG. 1, a backpack BP of the type generally shown in U. S. Pat. 5,564,612 of the assignee of this invention is shown with the buckle of this invention in use. In this case, the pack is shown without a belly band. The buckle, generally designated 10, is hardly visible and constitutes an unobtrusive yet critical element of the backpack BP. As shown the backpack is on a typical hiker but a more critical application of this invention is its use on a military pack.

The typical hiker as shown in FIG. 1, removes a backpack BP by slipping one arm out of one shoulder strap, for example, the right shoulder strap RSS, shown in FIG. 1 followed by the second arm out of the left shoulder strap unshown in the drawing. However, in the case where instant dropping of the backpack BP is required without the several maneuvers required for traditional pack removal, the user need only grasp and pull a depending flexible strap 13, best shown in FIG. 2 of one or both the left or right shoulder strap buckles 10L or 10R in the manner described below, and the backpack BP instantly drops off behind the user.

Figure 2:
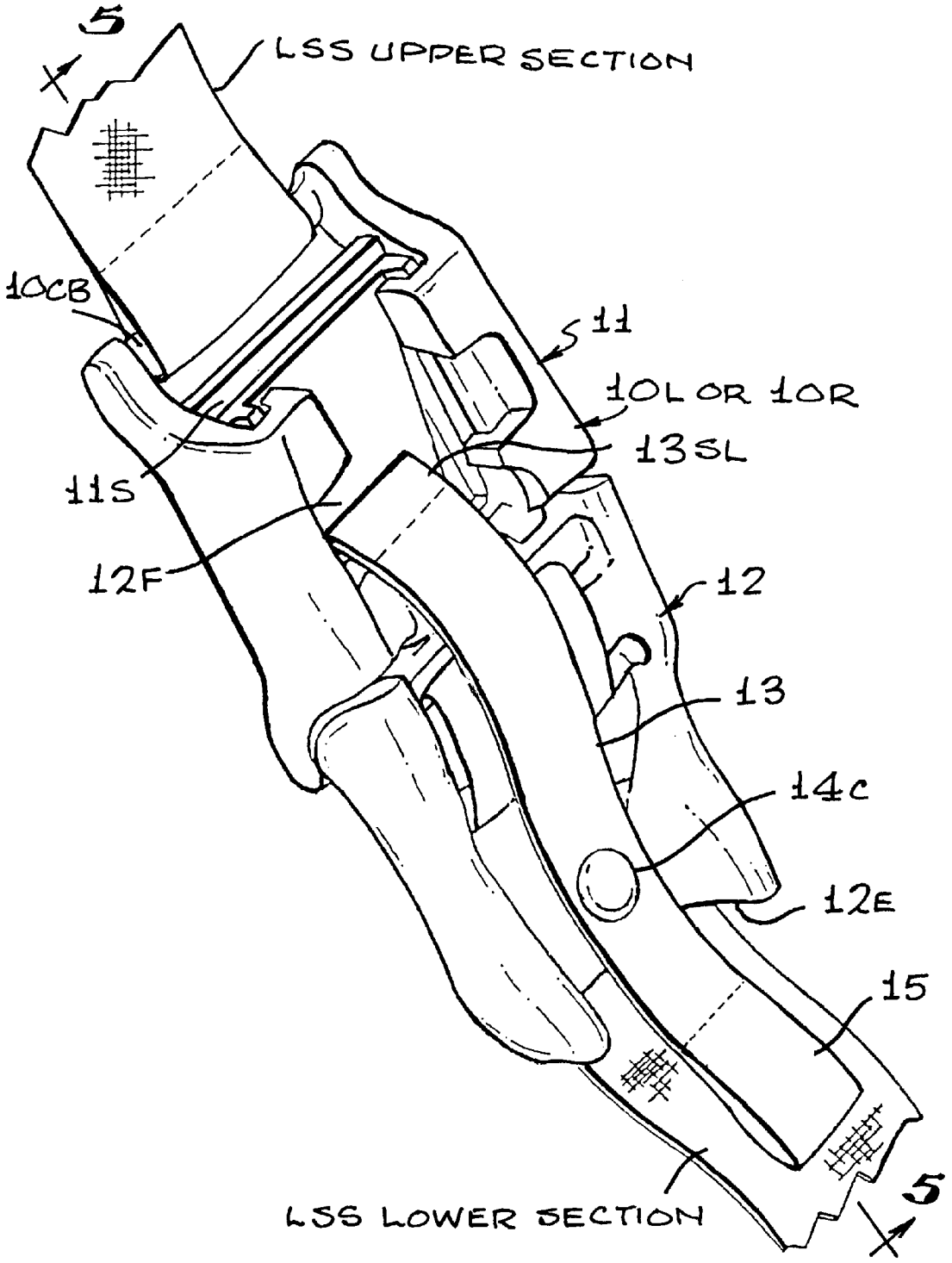
FIG. 2 is an enlarged perspective elevation view of the buckle of FIG. 1 including fragmentary portions of the straps to which the buckle parts are secured in a typical backpack shoulder strap application.

An example of the buckles 10L and 10R is best seen in FIG. 2 as being made up of two basic body parts. The buckle body parts comprise a receptor or female part 11 of FIGS. 2 and 3 and an engaging or male part 12 of FIGS. 2 and 4. The buckle 10 also includes a flexible strap 13 secured to the receptor part 11 by a stitched loop 13SL and selectively secured to the engaging part 12 by a snap fastener 14, the cap 14C of which appears in FIG. 2. The strap 13 includes an overhanging end 15 for grasping and release. The overhanging end 15 extends beyond the end 12E of engaging part 12.

Figure 3:
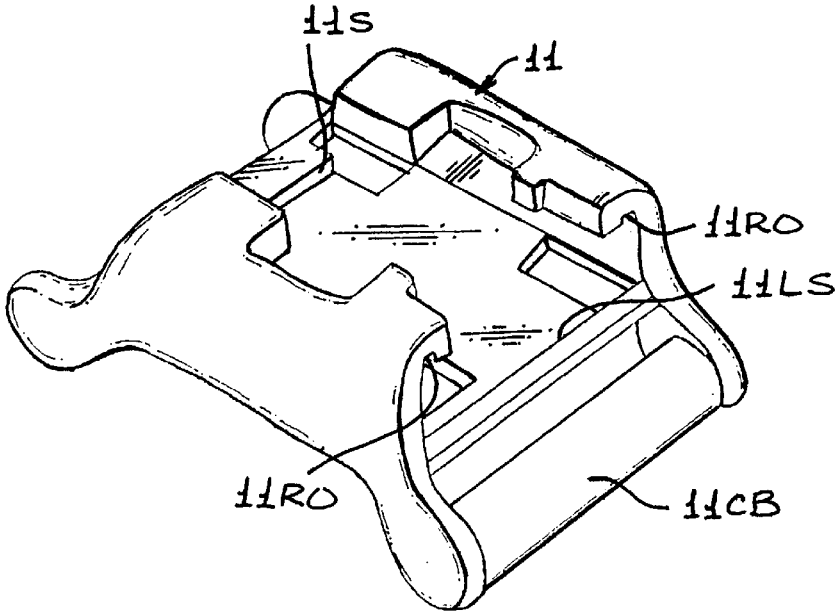
FIG. 3 is a perspective view of the female or receptor member of the buckle of FIGS. 1 and 2.
Figure 4:
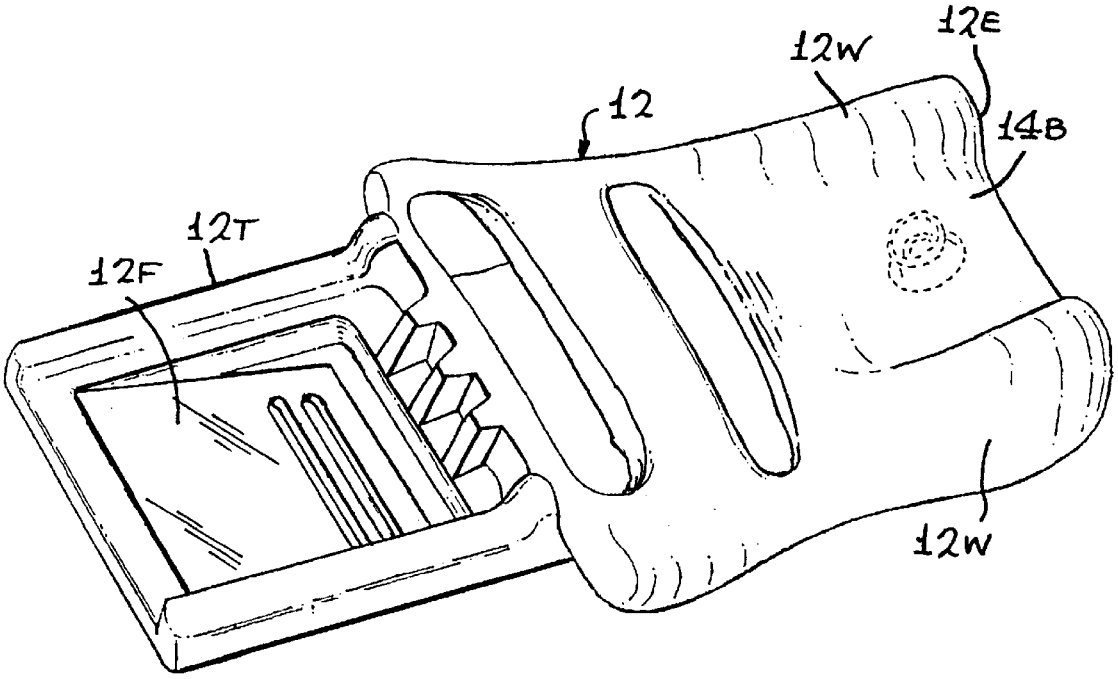
FIG. 4 perspective view of the male or engaging member of the buckle of FIG. 1.
Figure 5:
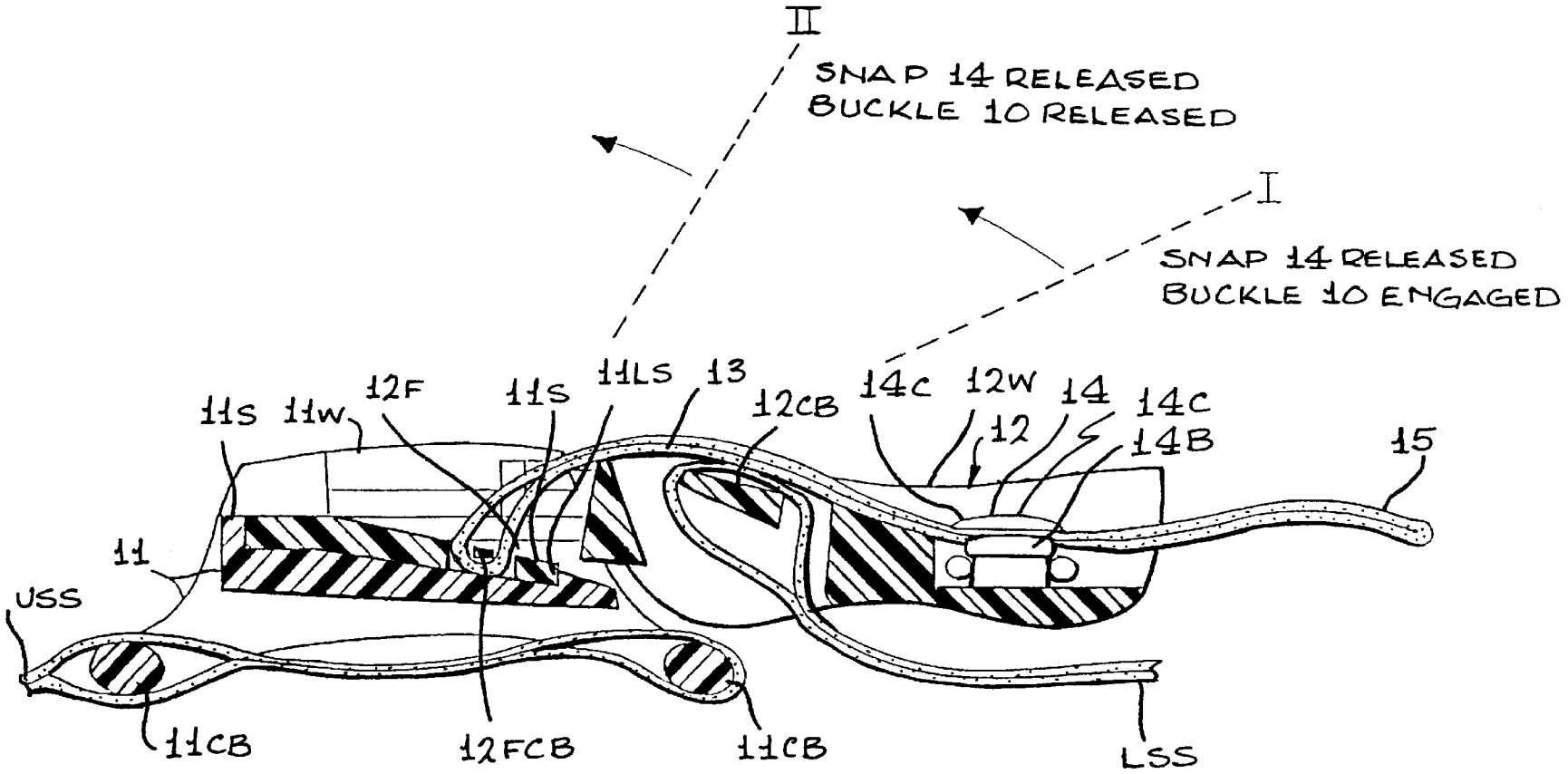
FIG. 5 longitudinal sectional view of the buckle of FIGS. 1& 2 taken along line 5—5 of FIG. 2.

The buckle 10 body parts 11 and 12, as best seen in FIGS. 3 and 4, respectively, are reengaged merely by holding the receptor body part 11 by its sides with its receptor opening 11RO of FIG. 3 by inserting a tang 12T shown in FIG. 4 of the engaging member 12 into the receptor opening 11RO. Locking of the buckle 10, as is described below, occurs when an integral flexible finger 12F appearing in FIG. 4 engages an internal locking step 11LS and an integral stop 11S of receptor 11 as is shown in FIGS. 3 and 5.

FIGS. 2 and 3 also illustrate that the receptor 11 includes a pair of cross bars 11CB, one shown in FIG. 2 with the left shoulder strap LSS encircling the upper cross bar 11CB. FIG. 3 shows the second or lower cross bar 11CB. These cross bars 11CB constitute attachment means for attaching the buckle body part 11 to a strap or belt. In certain applications the upper shoulder strap LSS will encircle both the cross bars 11CB for greater strength and security. Such an arrangement appears in FIG. 5.

FIG. 4 shows the base 14B of the snap fastener 14 secured to the outer end region 12E of the engaging part 12 opposite the tang 12T not in FIG. 4. Of major importance is the fact that the base 14B of the snap fastener 14 is secured to the engaging part between a pair of integral wings 12W which shield the snap fastener 14 and the strap 13 from any side contact which might otherwise result in unintended release of the buckle 10. The wings 12W are smooth in surface to avoid any place for catching on branches, the user's clothing or any other interfering object. Likewise, the wings 12W extend above the top of the cap 14C of the snap fastener 14 when it is properly engaged as is shown in FIGS. 2 and 5.

If the user passes a finger across the wings 12W of the buckle 10, and touches the cap 14C, the user knows even without looking that the snap fastener 14 is disengaged and takes corrective action snapping the fastener 14. He is thereby warned to engage the snap fastener 14 if not intending to release the buckle 10.

To engage the snap fastener, the user need only press a finger, gloved or bare against the face of receptor 12 between the wings 12W and the fastener 14 will easily engage. With the snap fastener 14 engaged, the buckle 10 will not open under any but abnormal severe stressed conditions outside of any expected or recommended use.

Now refer to FIG. 5 which is a longitudinal vertical sectional view of the buckle 10, engaged and locked by the snap fastener 14 and secured to a shoulder strap SS made up of two parts, the upper and lower shoulder strap parts LSS. The upper shoulder strap SS engages both cross bars 11CB. The lower shoulder strap LSS engages a single cross bar 12CB and extends below the part 12 and the fastener 14 and is secured to the lower portion of the backpack CB, BP unshown in FIG. 5 but appearing in FIG. 1.

In FIG. 5, the buckle parts 11 and 12 are secured together by the integral resilient finger 12F in engagement with the locking stop 11LS and limited in inward travel by the integral stop 11S. The finger 12F has sufficient resiliency so that it deflects upon insertion of the tang 12T into the receptor 11 to slide over the locking stop 11LS and the tang 12T continues until it reaches the integral stop 11S of receptor 11. The finger 11F snaps back to its normal downward angle and is then securely locked against the locking stop 11LS.

The strap 13 encircles an integral cross bar 12FCB in finger 12F and extend toward engaging part 12 within mating wings 11W of receptor 11 and the complementary wings 12W of the engaging part 12 to be below the level of the top surface of buckle 10 throughout the length of the buckle 10. Therefore the strap 13 is protected from snagging at any part of its length between the finger 12F and the snap fastener 14 by the wings 11W and 12W. Only the strap end 15 is exposed for grasping and release. The strap end 15 is flexible and free of any rigid parts which might snag on some object. This unintended freedom from release by contact with any foreign object is an important feature of this invention.

Another feature of this invention is illustrated in FIG. 5 and is noted in the drawing by a pair of dashed lines I and II radiating from the point of attachment of the strap 13 to the integral finger 12F. The line I illustrates an approximate angle at which the tab 13 is released from the snap fastener base 14B at which occurrence, the buckle 10 may be released. It does not, however, allow release of the buckle 10 at that point which still maintains its full holding power.

If the tab 13 is pulled further away from the buckle 10 to approximately the angle represented by line II, the finger 12F is flexed sufficiently to lift it from locking stop 11LS and the two buckle parts 11 and 12 will automatically separate in response to the weight of the backpack BP and the pack will fall off of the wearer. An unintentional release of the snap fastener 14 without the outward pull of the tab 13 to at least the angle denoted by line II will not allow the buckle 10 to separate.

The combination of each of the features described above results in the reliable locking yet quick release buckle of this invention.

The foregoing description and the drawings illustrate the concept of this invention but one must not consider that the invention is limited to the specific embodiments disclosed. Instead, this invention is defined by the following claims including the scope of protection afforded by the Doctrine of Equivalents.

What is claimed is:

1. A quick release buckle for use on backpacks and the like, comprising:

a buckle body including an engaging body part including attachment means for securing a web or strap at one end thereof and a tang at the opposite end thereof;

said buckle body including a receptor body part including attachment means for engaging a web or strap to be joined to said first web or strap;

said receptor body part including a recess therein for receiving the tang of said first body part;

said receptor body part also including catch means;

said engaging body part including a flexible finger extending into engagement with the catch means of said receptor body part when the tang of said first body part is inserted into the recess of said receptor body part;

flexible strap means secured at one end to said flexible finger for selectively deflecting said finger out of engagement with said catch means;

a first fastener part secured to said flexible strap means; and a mating second fastener part secured to said engaging body part;

wherein said engaging buckle body part includes wing means embracing said flexible strap means in the region of said mating second fastener for protecting said first fastener part from unintended disengagement from said mating second fastener part.

2. A quick release fastener in accordance with claim 1 wherein said flexible strap means extends beyond the end of said engaging body part opposite said tang for grasping of the flexible strap means and for release of said first fastener part and the separation of said buckle body parts.

3. A quick release buckle in accordance with claim 1 wherein said wing means extend above the level of said first fastener part when said first fastener part is engaged with said mating second fastener part.

4. A quick release buckle in accordance with claim 1 wherein said first fastener part and said mating second fastener part comprise a snap fastener.

5. A quick release buckle in accordance with claim 1 wherein said catch means of said receptor body part is located in the region of the entrance of the recess in said receptor body part.

6. A quick release buckle in accordance with claim 5 wherein said finger of said engaging body part which includes a proximal end is integral with said tang and a distal end which extends away from the end of the outermost end of said tang.

7. A quick release buckle in accordance with claim 1 wherein said flexible strap means is secured to said flexible finger and said engaging body part for releasing said flexible finger from said receptor body.

8. A quick release buckle in accordance with claim 1 wherein said engaging body part is of plastic and said flexible finger is integral therewith.

9. A quick release buckle in accordance with claim 8 wherein said tang is generally in the form of a rectangle and wherein said flexible finger is located within said rectangle.

10. A quick release buckle in accordance with claim 8 wherein said flexible finger includes a pair of transverse slots therein in the region of the distal end of said finger; and wherein said flexible strap means passes through said transverse slots for engagement with said flexible finger and for releasing said finger from said catch means.

11. A quick release buckle comprising:

A two part body including an engagement part and a receptor part;

said engagement part and said receptor part each including attachment means for securing a respective body part to a strap or belt to be joined by said buckle;

said engagement part and receptor part telescoping into engagement;

one of said body parts including a flexible finger and the other of said body parts including a catch which engage upon telescoping of said body parts to secure said body parts together;

a strap secured to said flexible finger to release said finger from said catch and allow said buckle body parts to separate;

a fastener for selectively fastening said strap to said buckle body;

said buckle body including at least one upstanding wing adjacent to said strap to shield said strap from unintended disengagement of said fastener.

12. A quick release buckle in accordance with claim 11, wherein said strap extends beyond an end of said buckle body.

13. A quick release buckle in accordance with claim 11, wherein said buckle body includes a pair of upstanding wings, one on each side of said strap when the strap is secured by said fastener.

14. A quick release buckle in accordance with claim 11, wherein said fastener is a snap fastener with one part secured to said strap and the second part secured to said buckle body.

15. A quick release buckle in accordance with claim 11, wherein said flexible finger is integral with said engagement part and said catch is integral with said receptor part.

16. A quick release buckle in accordance with claim 14, wherein said fastener secured to said buckle body is secured to said engagement part.

17. A quick release buckle in accordance with claim 11, wherein said finger is integral with said engagement body part.

18. A quick release buckle in accordance with claim 11, wherein said engagement part includes a tang and said flexible finger is integral with said tang.

19. A quick release buckle in accordance with claim 18, wherein said tang is generally rectangular and said flexible finger is secured to said tang within said tang.

20. A quick release buckle in accordance with claim 11, wherein said strap is flexible throughout its length.

21. A quick release buckle in accordance with claim 11, wherein said receptor part is open in the region adjacent to said flexible finger and said strap extends out of said opening.

* * * * *